United States Patent [19]

Nihara et al.

[11] Patent Number: 4,757,760

[45] Date of Patent: Jul. 19, 1988

[54] WIRE MASK FOR A DOT PRINTER HEAD APPARATUS

[75] Inventors: Shohachi Nihara, Tokyo; Michio Koizumi, Saitama; Masao Kunita, Saitama; Seiichi Ohsawa, Saitama, all of Japan

[73] Assignee: Citizen Watch Co., Ltd., Tokyo, Japan

[21] Appl. No.: 797,250

[22] Filed: Nov. 12, 1985

[30] Foreign Application Priority Data

Nov. 13, 1984 [JP] Japan ..... 59-172916[U]
Dec. 10, 1984 [JP] Japan ..... 59-187892[U]
Mar. 18, 1985 [JP] Japan ..... 60-38466[U]

[51] Int. Cl.[4] ..... B41J 35/04

[52] U.S. Cl. ..... 101/93.05; 400/124; 400/248; 400/645.1

[58] Field of Search ..... 101/93.04, 93.05, 93.29, 101/93.48; 400/124, 642, 645, 645.1, 248

[56] References Cited

U.S. PATENT DOCUMENTS

| | | | |
|---|---|---|---|
| 3,889,793 | 6/1975 | Cattaneo | 101/93.05 |
| 3,918,567 | 11/1975 | Kittredge | 101/93.04 |
| 4,313,683 | 2/1982 | Brown et al. | 400/248 |
| 4,373,438 | 2/1983 | Arai | 101/93.04 |
| 4,389,127 | 6/1983 | Bellinger | 101/93.05 |
| 4,391,541 | 7/1983 | Einem | 400/248 |
| 4,410,291 | 10/1983 | Speraggi | 400/645.1 |
| 4,496,256 | 1/1985 | McMorrow et al. | 400/248 |
| 4,552,064 | 11/1985 | Sanders, Jr. et al. | 101/93.05 |
| 4,569,604 | 2/1986 | Adachi et al. | 101/93.05 |
| 4,569,605 | 2/1986 | Meier et al. | 101/93.05 |
| 4,572,681 | 2/1986 | Miyazawa et al. | 101/93.05 |

FOREIGN PATENT DOCUMENTS

| | | | |
|---|---|---|---|
| 87387 | 5/1982 | Japan | 400/645 |
| 31789 | 2/1983 | Japan | 400/248 |
| 171973 | 10/1983 | Japan | 101/93.04 |
| 2108049 | 5/1983 | United Kingdom | 400/248 |

*Primary Examiner*—David A. Wiecking
*Attorney, Agent, or Firm*—Koda and Androlia

[57] ABSTRACT

A printing head apparatus for a dot printer including a frame and at least one printing wire unit which is secured to the frame. The printing wire unit has an electromagnetic actuator and a printing spring with one stationary end and a printing wire attached to the other end thereof. The printing spring carries an armature at an appropriate central portion thereof facing the core of the electromagnetic actuator. The printing spring is flat and tapered toward the distal end, and a bent portion is provided on the flat portion for securing the printing wire, while an indented portion is provided on the base portion of the printing spring. A wire mask enables the ink ribbon to be smoothly fed.

1 Claim, 6 Drawing Sheets

WIRE MASK FOR A DOT PRINTER HEAD APPARATUS

BACKGROUND OF THE INVENTION

1. Field of the Invention

This invention relates to a printing head apparatus for a dot printer, and more particularly to a printing wire unit efficient in responsiveness at the time of high-speed printing.

2. Description of the Prior Art

Dot printers which can print characters, numerals and other symbols on printing paper with a plurality of dots grouped together are known and have been widely used as printers for the computer data processing systems which have been developed in recent years because they can provide a character of any desired configuration by a certain combination of dots.

In order to increase the printing speed of such a dot printer, it is required that a printing head carrying printing wires moves at a higher speed in the direction of a line or a column in relation to a platen or printing paper. However, since the speed at which the head moves is naturally limited by the responsiveness of the electromagnetic actuator which drives the printing wire and other factors, in the prior art, in order to enable high-speed printing, a plurality of printing wires are arranged in alignment in the longitudinal direction of the platen at regular intervals and a group of printing wires are driven simultaneously in accordance with the respective printing commands. This kind of printer is known as a dot line printer.

The structure of a conventional printing unit including such an electromagnetic actuator and a printing wire driven thereby is shown in FIG. 13. The unit is provided with a printing spring c having the configuration of a thin rectangular sheet with an armature a disposed at an intermediate position and a printing wire b carried at one end; and the core e of an electromagnetic actuator d which is opposed to the armature a; the other end of the printing spring c being secured to a base portion f.

When the electromagnetic actuator d is energized in the above-described structure, the armature a is attracted by the core e, whereby the printing spring c is caused to bend such as to drive the printing wire b toward the platen and in the direction indicated by the arrow.

In the above-described conventional device, however, since the spring c is supported only at one end and has a rectangular configuration with a uniform section, the total weight of the spring c is large, and the time consumed in impacting the wire is long, so that the printing speed is disadvantageously slow.

Furthermore, with respect to the configuration of the section of the spring c, the rigidity of the portion of the leaf spring between the position at which the armature a is attached and the position at which the printing wire b is secured is small. As a result, the responsiveness of the printing wire b at the time of attracting and driving the armature a at a high speed is poor, and further, when the distal end of the printing wire b strikes the platen, it cannot produce an adequate degree of printing pressure.

It is preferable in such a dot line printer to arrange the printing wires in alignment with each other and in correspondence with all the dots which are required for printing one line. This arrangement, however, cannot be realized because it is impossible to retain a sufficiently wide space to allow the necessary number of electromagnetic actuators to be arranged, not to mention the viewpoint of economy.

To solve this problem, a device has been put into practical use which has a structure in which the number of printing wires arranged in line at certain intervals corresponds to a reduced number of dots selected from the total number of dots necessary for printing one line, and in which a frame wire carrying the printing wires is reciprocally driven only between adjacent frame wire positions in such a manner as to operate "false" simultaneous printing. This device is known as a shuttle printer.

A conventional shuttle type dot printer is composed of a shuttle frame on which a plurality of printing wires and electromagnetic actuators are arranged in alignment and secured thereto, as is disclosed in Japanese patent Laid-Open No. 131470/1984.

In this improved dot line printer, the permanent magnet for providing urging force to the printing wire in advance is eliminated in order to reduce the weight of the printing head, and hence the shuttle itself, and a balance weight which is required when driving the shuttle in the prior art is dispensed with.

A wire mask made of a thin sheet is provided on the surface facing the ink ribbon of the shuttle so as to separate the shuttle body from the ink ribbon. In an ordinary case, the wire mask is secured to the shuttle frame so as to prevent the distal ends of the wires, the wire guides, and the like from being damaged by coming into contact with the ribbon, or the printing wires themselves from being damaged.

On the front surface of the wire mask, a ribbon mask smaller in thickness than the wire mask is fixed so as to prevent the printing paper from being stained by separation of the ink ribbon from the printing paper.

However, in the conventional device in which a wire mask of a thin stainless sheet or the like is inserted between the shuttle frame and the platen and a ribbon mask is attached to the front surface of the wire mask in this way, it is difficult to hold a long wire mask such that it smoothly extends over the entire surface in a printer device having a shuttle frame of a comparatively long width, and in practice, the wire mask and the ink ribbon are sometimes caused to crinkle, thereby making it impossible to secure the smooth passage for the printing paper. This phenomenon further leads to irregular travel and damage of the printing paper, and thus to considerable degradation in printing quality.

SUMMARY OF THE INVENTION

Accordingly, it is an object of the invention to eliminate the above-described problems and to provide a printing wire unit which is efficient in responsiveness at the time of a high speed operation, and which allows the size and the weight of an electromagnetic actuator to be reduced.

It is another object of the invention to provide an improved shuttle device which enables high speed printing by making the distance between the end of the wire and the platen as short as possible, and which enables smooth travelling of the ink ribbon and the printing paper by holding the wire mask in close contact with the shuttle frame, removing any crinkling of the wire mask, keeping a fixed space between the wire mask and the printing paper and between the wire mask and the ink ribbon, and securing smooth passage for the ink ribbon and the printing paper.

To achieve this aim, this invention provides a printing head composed of a base plate, and a printing wire unit secured to the base plate. The printing wire unit is composed of a flat printing spring with one stationary end, a printing wire secured to the free end of the spring, and an armature attached to an intermediate position of the printing spring. The portion of the printing spring between the position to which the armature is attached and the free end is bent approximately at right angles, constituting a bent portion, and the remaining flat portion has a tapered form. The printing wire is secured to the end of the bent portion, while an indented portion is provided between the position to which the armature is fixed and the stationary end.

The wire guide holder is provided such as to protrude from a shuttle frame toward the platen and a wire mask is secured to the shuttle frame in such a manner that the upper and lower ends thereof are strained backwardly with a plurality of wire guide holders as an apex. That is, the wire mask is secured in a convex state such that the front surface of the wire mask is held in close contact with the wire guide holders, whereby the wire mask is safely prevented from crinkling and being pressed against the printing paper or the ribbon by strong uneven force.

The above and other objects, features and advantages of the present invention will become clear from the following description of the preferred embodiment thereof, taken in conjunction with the accompanying drawings.

DESCRIPTION OF THE PREFERRED EMBODIMENT

An embodiment of the present invention will be explained in the following with reference to the accompanying drawings.

Figure 1:
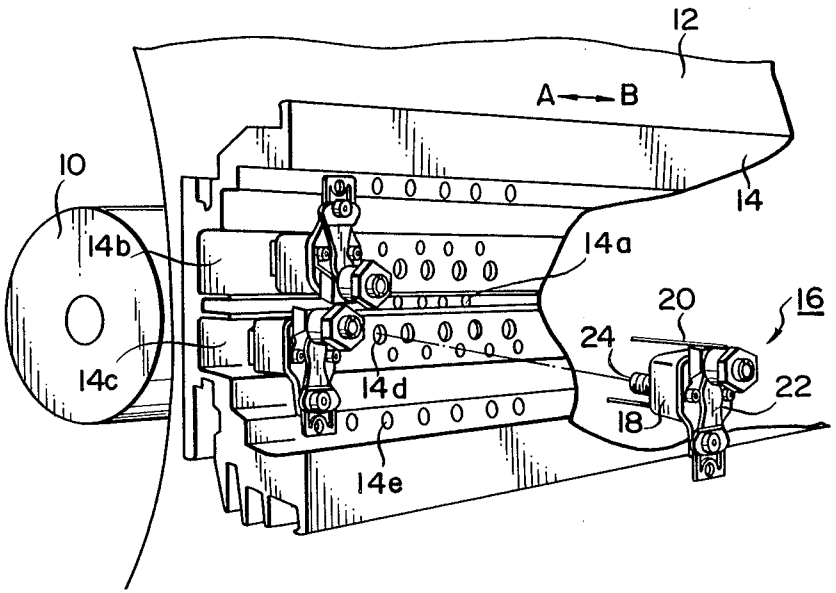
FIG. 1 is a perspective view of the entire structure of a shuttle type dot printer incorporating a printing head apparatus according to the invention.

Referring first to FIG. 1, a shuttle type dot line printer to which a printing head according to the invention is applied is schematically shown. A platen 10 holds printing paper 12 in the wound state, and a shuttle frame 14 is supported such as to be reciprocally driven in the directions indicated by the arrows A and B in relation to the platen 10 and the printing paper 12. Dotted letters can be formed on the printing paper 12 during the reciprocal movement of the shuttle frame 14. The shuttle frame 14 itself is, as will be described later, preferably made of a light material such as aluminum so as to have a reduced weight, and it also serves as a heat radiator for efficiently releasing the heat of the wire printing heads.

Wire holes **14*a* through which printing wires project are arranged in alignment in an approximately central portion of the shuttle frame 14, and a plurality of printing wire units 16 of the invention are firmly fixed into grooves 14*b* and 14*c* provided on the upper and lower sides of the wire holes 14*a*** in such a manner that adjacent printing wire units are alternately disposed in opposite directions relative to each other.

Each of the printing wire units 16 integrally incorporates a sub-unit 23 composed of an electromagnetic actuator 18 and a printing spring 22 which carries a printing wire 20. The printing wire unit 16 has, in the above-described state, each component firmly fixed and positionally adjusted perfectly.

Figure 2:
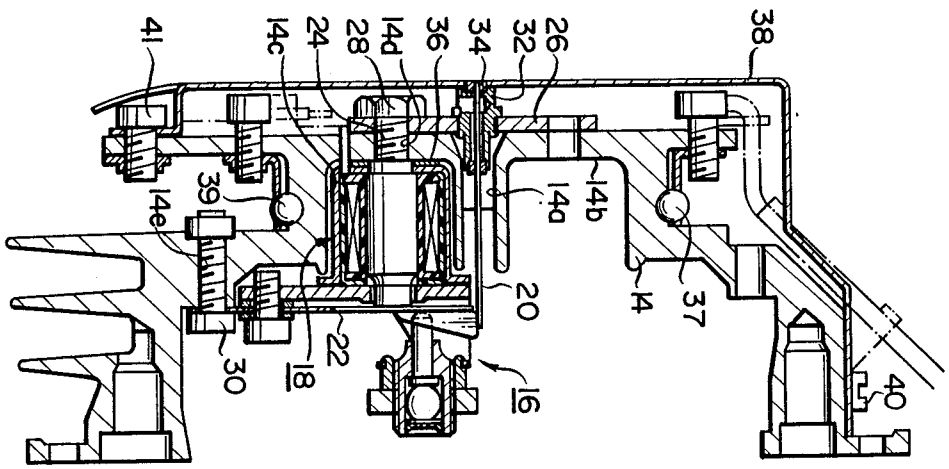
FIG. 2 is a sectional view of the main part of the dot line printer shown in FIG. 1, showing the state in which a wire printing unit according to the invention is attached to the shuttle frame.

FIG. 2 shows the state in which the printing wire unit 16 is secured to and held by the shuttle frame 14. The printing wire unit 16 is firmly secured to the shuttle frame 14 by passing a screw 24 protruding from one end of the actuator 18 through a through hole **14*d* of the shuttle frame 14 and fitting a fixing nut 28 over the screw 24 with a wire guide plate 26** inserted therebetween.

The tail end of the printing spring 22 is fastened to the shuttle frame 14 by a screw 30 inserted into a through hole **14*e*. Thus the printing wire unit 16 is firmly fixed to the shuttle frame 14** such that any rotational movement is prevented.

To the wire guide plate 26 a wire guide holder 32 which is loosely inserted into the wire hole **14*a* of the shuttle frame 14 is secured by caulking. A wire guide 34 for guiding and positioning the printing wire 20 at the correct position is secured to the wire guide holder 32, and the printing wire 20 is reciprocally moved toward the printing paper 12 by the actuator 18 while being slidably supported by the printing guide 34**.

Although the assembly and adjustment of the printing wire unit 16 itself has been completed as a printing head, as described above, it is preferable that a spacer 36 of an appropriate thickness is inserted between the electromagnetic actuator 18 and the groove **14*c* (14*d*) of the shuttle frame 14 in order to correctly adjust the distal end position of the printing wire 20 in the state wherein the printing wire unit 16 is attached to the shuttle frame 14. In this way, the final position of the printing wire 20** is determined.

The shuttle frame 14 efficiently releases the heat of each of the plurality of printing wire units arranged in alignment on the shuttle frame 14. A temperature sensor for detecting the temperature of the frame 14 which is composed of a thermistor or the like is attached to at least one side of the frame 14, thermistors 37 and 39, respectively, being provided on both sides in this embodiment, thereby effecting a control which prevents excessive electric current from flowing to the respective electromagnetic coils.

Figure 3:
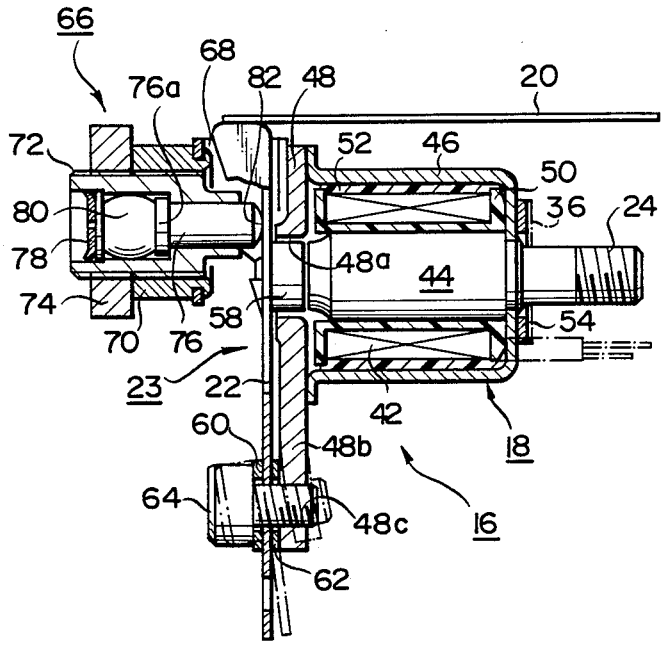
FIG. 3 is a sectional view of the main part of the wire unit shown in FIGS. 1 and 2.
Figure 4:
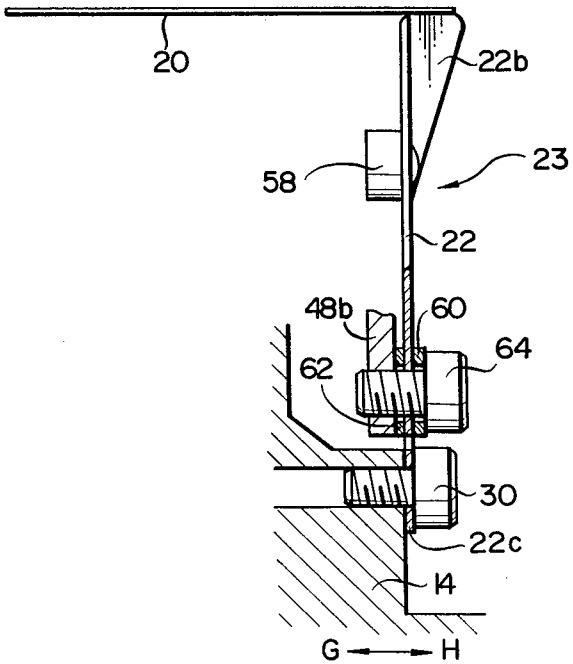
FIG. 4 is a sectional view of the main part of a sub-unit of the printing wire unit shown in FIG. 3, showing the state in which the sub-unit is secured to the shuttle frame.

FIGS. 3 and 4 show the detailed structure of the printing wire unit 16.

In order to reduce the size of a printer and increase the driving efficiency of the printing wire 20, the electromagnetic actuator 18 in the invention is formed as a closed magnetic circuit type actuator, in which a core 44 with a coil 42 wound therearound is enclosed in a shell 46 by the shell 46 and a yoke 48 in a substantially sealed state.

The fixing screw 24 protruding from the electromagnetic actuator 18 is provided integrally with the core 44, and the coil 42 wound around a bobbin 50 is mounted on the core 44.

The shell 46 in this embodiment has a square section and is formed by drawing. The shell 46 in this embodiment having a square cross section enables the area where the outer surface of the shell and the shuttle frame 14 come into contact with each other to be made large when the shell is fixed into the groove **14*b* (14*c*) of the shuttle frame 14, as shown in FIG. 1, whereby the heat can be rapidly transferred from the electromagnetic actuator 18 to the shuttle frame 14. In addition, the square-shaped shell 46 produces a space larger than necessary between the coil 42 housed therein and the shell 46 itself. In this embodiment, this space is filled with an epoxy resin filling material 52 having high thermal conductivity, which rapidly transfers the heat generated in the coil 42 to the shell 46 through the filling material 52 of high thermal conductivity, and further to the shuttle frame 14. Naturally, the space between the shell 46 and the shuttle frame 14 is also preferably filled with the filling material 52** of high thermal conductivity.

A spacer ring 46 is fixed on the outside of the bottom surface of the shell 46 by adhesion or welding, so that one end surface of the spacer ring 36 prevents protrusion of the caulking portion or the like of the core at the base end of the fixing screw 24 in relation to the shell 46, and the flat portion of the other end surface is utilized for fixing the printing wire unit 16 at the correct position of the groove of the shuttle frame 14. It goes without saying that the spacer 36 is provided between the spacer ring 54 and the shuttle frame 14, if this is necessary.

The end surface of the core 44 constitutes a surface which comes into contact with an armature which is provided on the printing spring 22, and which will be described later; this end surface is very important as the reference surface of the electromagnetic actuator 18. It is also very important in the present invention to establish a correct positional relationship between the shell 46 and the armature 48 which form the closed magnetic circuit, and between the opening end of the shell 46 and the end surface of the core 44, because the yoke 48 serves as the fixing base end of the printing spring 22 carrying the armature.

The yoke 48 constituting the closed magnetic circuit type electromagnetic actuator is welded to the shell 46 with the opening end thereof correctly finished by grinding. Accordingly, the electromagnetic actuator 18 forms a substantially closed magnetic circuit from the core 44, the shell 46 to the yoke 48. An armature 58 secured to the printing spring 22 is loosely inserted into an opening **48*a* of the yoke 48 at the correct position, whereby the armature 58 constitutes part of the closed magnetic circuit of the electromagnetic actuator 18, and therefore highly efficient magnetic attractive force can be provided for the armature 58**.

As shown in FIG. 3, the edge of the opening portion **48*a* of the yoke 48 is bent slightly outwardly, so that the magnetic flux of the electromagnetic actuator 18 is caused to flow to the armature 58 without any leakage to the core 44. For example, press stamping of the yoke 48 from the righthand side in FIG. 3 for forming the opening portion 48*a* and drilling finish of the inner periphery thereof can easily provide the slightly outwardly bent edge of the opening portion 48*a***.

The yoke 48 has a supporting portion **48*b* which extends downwardly in FIG. 3, and a tapped hole 48*c* at the lower end of the supporting portion 48*b* serves as the reference position for support of the printing spring 22. In other words, the printing spring 22 is firmly fixed to the supporting portion 48*b* of the yoke 48 at its one end by a screw 64 through spacers 60 and 62**.

Since the printing spring 22 can be directly fixed to the yoke 48 in this way, the positional relationship between them can be established with high accuracy. As a result, the armature 58 can be arranged in extremely close relation to the opening portion **48*a* of the yoke 48 and the magnetic gap between the yoke 48 and the armature 58** can be set at a minimum value, thereby greatly increasing the magnetic efficiency.

As is known, when the electromagnetic actuator 18 is excited by a printing command, the printing spring 22 is attracted until the armature 58 comes into contact with the core 44, whereby the printing wire 20 can be driven to correctly strike against toward the printing paper 12. At this time, it is necessary to set the space between the core 44 and the armature 58 accurately in order to exactly determine in positional terms the stroke of the printing wire 20 and the electromagnetic driving force, and to obtain an exact impact force and period of impact; if the gap is larger than the predetermined value, the period of impact becomes longer, while if it is smaller, the impact force becomes smaller.

If the accuracy of each component must be increased in order to accurately set the gap between the core 44 and the armature 58, the cost is disadvantageously raised.

In this embodiment, therefore, in order to accurately set the gap between the core 44 and the armature 58 at the predetermined value, a support piece **48*b* of the yoke 48** is bent in a predetermined manner.

If the printing spring 22 is arranged in parallel to the yoke 48, as is shown by the solid line in FIG. 3, the core 44 comes into close contact with the armature 58. When the coil 42 is energized in this state, the core 44 does not drive the armature 58, nor does the armature move even after the magnetizing current is cut off. Accordingly, in this embodiment, the supporting portion **48*b* of the yoke 48 is slightly bent in the counterclockwise direction at its one end, as is shown by the broken line (the degree of bending is enlarged for the purpose of illustration), such as to set the gap between the core 44 and the armature 58** at a predetermined value. The use of a jig facilitates the setting of the gap at the predetermined value.

The armature 58 is secured to the printing spring 22 by, for example, caulking, and the printing wire 20 is brazed on the end of the printing spring 22, whereby the printing wire unit 16 in this embodiment assumes a state in which the printing spring 22 is secured to the yoke 48 of the electromagnetic actuator 18.

Figure 5:
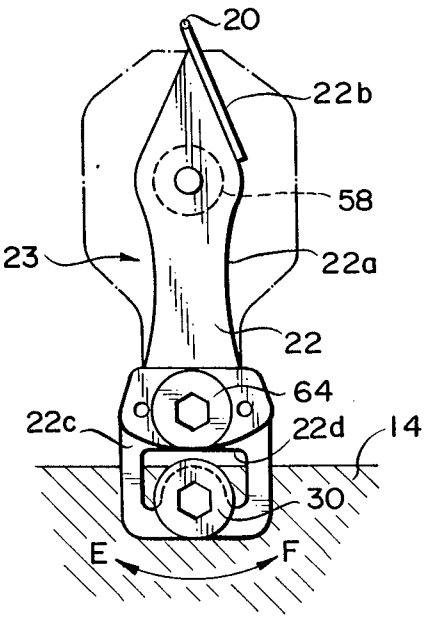
FIG. 5 is a side elevational view of the sub-unit shown in FIG. 4, viewed from the righthand side.

FIGS. 4 and 5 show the structure of a sub-unit 23 of the printing head for a dot printer according to the invention, and the structure for attaching the end portion of the sub-unit to the shuttle frame 14. The sub-unit 23 is composed of the printing spring 22, the printing wire 20 attached to one end of the printing spring 22, and the armature 58 attached at an intermediate position of the printing spring 22. The spring 22 is supported by and fixed to the supporting portion 48*b* of the yoke 48 at its one end by the screw 64.

The printing head according to the invention is characterized in that the printing spring 22 is provided with an indented portion 22*a* between the armature 58 and the position where the printing spring is supported by the supporting portion 48*b*, as is shown in FIG. 5, in that the printing spring 22 is also provided with a bent portion 22*b* forward of (above in FIGS. 4 and 5) the armature 58 and is tapered toward the distal end, and in that the printing wire 20 is brazed at the distal end of the bent portion 22*b*.

Consequently, the printing wire 22 is caused to be bent mainly at the indented portion 22*a*, and it is reinforced by the bent portion 22*b*, so that the rigidity of the printing spring 22 at the portion between the armature fixing portion and the distal end is enhanced. This increased rigidity eliminates the time lag between the action of the printing wire 20 and that of the armature 58 which occurs when the armature 58 is attracted in the prior art, and thus the printing wire 20 operates securely in combination with the attraction of the electromagnetic actuator 18. If the printing wire 20 is attached to the bent portion 22*b* in the longitudinal direction of the end surface thereof, the attachment operation is facilitated and the fixing force is enhanced. The flat portion of the printing spring 22 is tapered, while the bent portion 22*b* broadens toward the distal end. This configuration of the printing spring enables the total weight of the printing wire unit 23 to be reduced, and allows high speed responsiveness to be realized when it is attracted by the electromagnetic actuator 18. The width of the bent portion is made large in order to firmly hold the printing wire 20, while the printing spring 20 becomes narrower as it approaches the stationary end in order to reduce the weight of the printing spring 22 as a whole.

A whirl stop supporter 22*c* is provided at the lower end of the printing spring 22 and is fixed to the shuttle frame 14 by the screw 30. An opening 22*d* is formed on the whirl stop supporter 22*c* so that rotation of the printing spring 22 in the direction indicated by the arrows E and F in FIG. 5 is securely halted, while the movement in the directions indicated by the arrows G and H in FIG. 4 can be sufficiently absorbed. Thus, when the printing wire unit 16 is fixed to the shuttle frame 14, changes in the axial direction can be absorbed by the whirl stop supporter 22*c*.

In this embodiment, a damper 66 is provided on the printing spring 22 for preventing any rebound of the spring 22 at the time of its return from striking the printing wire against the printing paper and this damper 66 is also directly fixed to the yoke 48; the printing wire unit 16 in this embodiment thus incorporates the damper 66.

In FIG. 3, the damper 66 is directly screwed to the yoke 48 by a bridge-shaped blank 68 with a holder 70 attached thereto. A damper guide 72 is screwed into the holder 70 and a nut 74 is screwed to the damper guide 72, whereby the damper guide 72 can be correctly positioned and fixed at a desired position in the axial direction.

The damper guide 72 supports a spring receiving shaft 76 so as to be slidable in the axial direction, and serves as a damper together with an elastic member 80 provided between a flange 76*a* and a stopper plate 78.

In the embodiment, a rubber plate 82 is fixed as a shock absorber on the distal end of the spring receiving shaft 76 so that direct shock between the printing spring 22 and the spring receiving shaft 76 is eliminated and thereby friction therebetween at the portion of contact is reduced.

This embodiment is so designed that the total equivalent mass of the printing spring 22 together with all components attached thereto is approximately equal to that of the spring receiving shaft 76 of the damper 66 at the point where both come into contact with each other. As a result, the energy produced when the printing spring 22 returns is securely absorbed by the elastic member 80 of the damper 66 after being converted into the momentum of the spring receiving shaft 76. Since the energy retained by the printing spring 22 at the point where it returns to its original position is discharged to the damper 66 as described above, the printing spring 22 can stop instantly at this moment when it reaches its original position.

Figure 6:
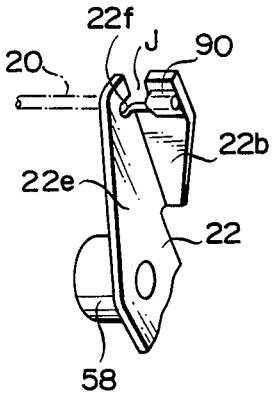
FIG. 6 is a perspective view of the main part of a joint where a spring and a printing wire are connected.
Figure 7:
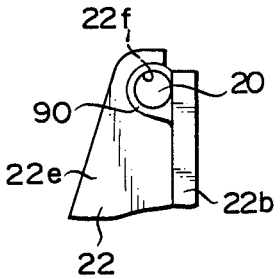
FIG. 7 is a side elevational view of the main part of the joint shown in FIG. 6.

As described above, the printing wire 20 is brazed to the bent portion 22*b* of the printing spring 22, a preferred example of this brazing portion being shown in FIGS. 6 and 7.

The printing spring 22 to which the printing wire 20 is secured has a flat portion 22*e* which is approximately perpendicular to the printing wire 20. An arcuate wire hole 22*f* through which the printing wire 20 is passed is provided on the flat portion 22*e* such as to surround at least half the circumference of the printing wire 20. The bent portion 22*b* is formed on the side surface of the printing spring 22 on which the wire hole 22*f* is disposed in such a manner that the longitudinal side surface of the printing wire 20 comes into contact with the bent portion 22*b* when the printing wire 20 is inserted into the wire hole 22*f*. The printing wire 20 is inserted into the wire hole 22*f*, and is positioned by a positioning jig with the longitudinal side surface of the printing wire 20 in parallel to the bent portion 22*b*. The printing wire 20 is brazed to the bent portion 22*b* in this state. Brazing material 90 flows into the vicinity of the wire hole 22*f* at the time of brazing, whereby the bonding strength is increased. The armature 58 is caulked to the printing wire 22.

Since the printing wire 20 is fixed in contact with the wire hole 22*f* and the bent portion 22*b*, the brazing area becomes large and the brazing strength and the brazing properties are improved. Furthermore, since the printing wire 20 is surrounded by the wire hole 22*f* and the bent portion 22*b*, even if force in the lateral direction is repeatedly applied to the free end of the printing wire 20, the brazing material 90 is prevented from being peeled off. The attachment of the printing wire 20 to the printing spring 22 is conducted by a very small number of steps, namely, the step of bending the printing spring 22 and the step of brazing, and requires no other superfluous parts.

In the example shown in FIGS. 6 and 7, the printing spring 22 is provided with a notch J between the wire hole 22*f* and the bent portion 22*b*. Although the notch J is not essential, it is preferable from the viewpoint of mass, because the mass on the distal end side of the printing spring 22 lends influence to the responsiveness and reduction in mass on the distal end side of the printing spring 22 by formation of the notch J brings about better effects. The notch J is also effective in preventing any deformation of the wire hole 22*f* which might be produced when the printing wire 22 is bent so as to form the bent portion 22*b*, and thereby in retaining an appropriate gap between the outer periphery of the printing wire 20 and the wire hole 22*f*. The bonding strength is maintained more effectively by brazing of the printing wire 20 to both the bent portion 22*b* and the wire hole 22*f*, but brazing it only to the bent portion 22*b* also brings about better effects than are obtainable in the prior art.

As is obvious from FIG. 2, a wire mask 38 is secured to the entire surface of the shuttle frame 14 in this embodiment by a plurality of screws 40 and 41, thereby separating the shuttle frame 14, especially the printing wire 20 from the platen 10, and preventing the ink ribbon and the printing wire 20 and the wire guide 34 from coming into contact with each other at the time of the reciprocating motion of the shuttle frame 14.

The wire mask 38 is firmly secured to the shuttle frame 14 by the screws 40 and 41 in such a manner that the upper and lower ends thereof are strained backwardly with the wire guide holder 32 as an apex. This tension secures the wire mask 38 to the shuttle frame 14 in a convex form with the wire holder 32 as an apex and ensures prevention of crinkling of the surface of the wire mask 38 which tends to be caused in the prior art.

The wire guide holder 32 is correctly positioned at its distal end and, according to the invention, the wire mask 38 is strained backwardly and fixed on the basis of the correct position of the distal end of the wire guide holder 32. Accordingly, the wire mask 38 at no points protrudes into the platen side at the position opposing the platen 10, and since the ribbon mask provided on the front surface of the wire mask 38 acts in combination with the wire mask 38, the ribbon mask can securely prevent any contact pressure from being locally applied to the printing paper.

In actual assembly, the wire mask 38 is fixed to the shuttle frame 14 in the following way. The opening portions through which the printing wires 20 protrude are first located at the positions facing the guide holders 32. The upper end of the wire mask 38 is next fastened to the shuttle frame 14 by the screws 40, and the lower end to the lower portion of the shuttle frame 14 by tightening the screw 41. In this way, the wire mask 38 is fixed to the shuttle frame 14 in the state in which the upper and lower ends are strained backwardly and in a concave configuration, with the wire guide holders 32 as an apex, as described above.

In the conventional device, the presence of the wire guide 34 requires that the position of the wire guide 34 be apart from the platen 10 by a distance equivalent to the thickness of the wire mask 38, but in this embodiment, the wire guide 34 can be disposed at the nearest possible position to the platen 10 in the above-described way. Consequently, high speed printing is enabled and smooth passage for the travel of the ink ribbon and the printing paper is secured.

Figure 8:
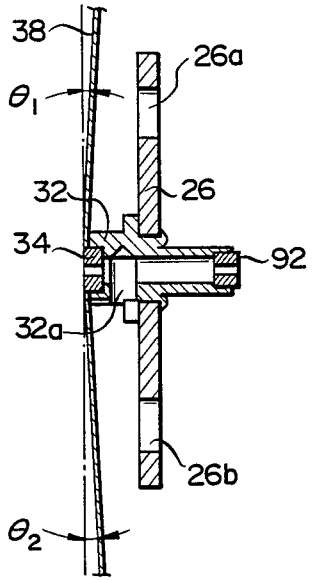
FIG. 8 is a sectional view of a wire guide holder and a wire mask, which are the main part of a shuttle frame device according to the invention.
Figure 9:
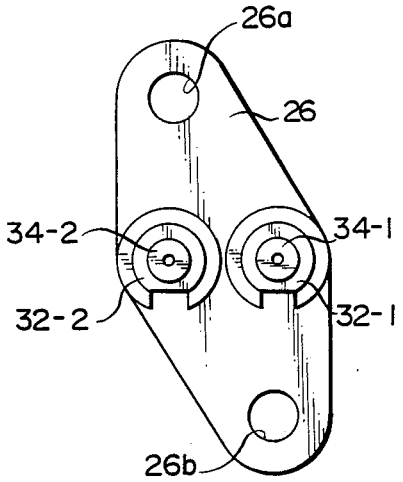
FIG. 9 is a plan view of the wire guide holder and the wire mask shown in FIG. 8, in the state in which two wire guides are placed adjacently on a wire guide plate.

FIGS. 8 and 9 are enlarged views of the structure of the wire guide portion. As is clear from the drawings, two wire guides 34-1 and 34-2 for bearing two adjacent printing wires are provided on the wire guide plate 26 and are supported by two guide holders 32-1 and 32-2, respectively. The wire guide plate 26 is secured to the shuttle frame 14 by tightening the fixing nuts 28 engaged with the screws 24 of the printing wire units 16 driven into thread holes 26*a* and 26*b*. Since a jig is used when the wire guide plate is secured, it is possible to correctly position and fix the two adjacent wire guides 34.

The wire guide 34, which is preferably formed of a bearing of ceramics, precious stone or the like, is pressed into the receiving hole provided at the distal end of the wire guide holder 32.

It is characteristic of this embodiment that the wire guide 34 is not pressed until it is embedded in the wire guide holder 32, but is fixed with the end protruding slightly, specifically by the amount approximately equal to the thickness of the wire mask 32, whereby the distal end of the wire guide 34 is located at the forwardmost end of the shuttle frame portion.

Since the length of the portion of the wire guide 34 which protrudes from the wire guide holder 32 is approximately equal to the thickness of the wire mask 38, the forwardmost end of the shuttle frame portion is almost in alignment with the front surface of the wire guide 34 and the front surface of the wire guide mask 38, as shown in FIG. 8. As a result, it is possible to hold the printing wire at the nearest possible position to the platen, and, in addition, the operation of separating the wire mask 38 from the printing paper is not obstructed.

In an ordinary case, the wire mask 38 has a thickness of about 0.3 mm, and in this embodiment the wire guide 34 is disposed at a position which is 0.3 mm nearer to the platen than in the prior art. Accordingly, when, in practice, printing with a group of minute dots, since the distance between the distal end of the printing wire and the platen can be made short, high speed printing is enabled and, in addition, since the distal end of the printing wire is in alignment with the surface of the wire guide, the ink ribbon never becomes caught by the end of the printing wire.

An intermediate guide 92 made of a precious stone is fit into the tail end of the wire guide holder 32 for supporting a long printing wire at an intermediate position so as to prevent the printing wire from being folded. The intermediate guide 92 is disposed such as to support a connecting pipe which connects the base portion of the printing wire and the distal end portion thereof.

The wire guide holder 32 is provided with an outlet 32*a* on the underside thereof in the vertical direction. The outlet 32*a* serves as a point of discharge for the ink which penetrates into the wire guide holder 32 from the gap between the printing wire and the wire guide 34.

The wire mask 38 is strained and held in a state in which the portion above the wire guide 34 is inclined in the clockwise direction by an angle of $\theta_1$ degrees from the vertical line, while the portion below the wire guide 34 is inclined counterclockwise by an angle of $\theta_2$ degrees from the vertical line.

Though in the wire mask 38 shown in FIG. 8, the angles $\theta_1$ and $\theta_2$ are enlarged for the sake of a better understanding, it is clearly found that when the wire mask 38 is strained clockwise and counterclockwise, respectively, with the wire mask 38 as an apex, no crinkles or unevenness on the surface are produced in the direction in which the shuttle frame moves, and the wire mask 38 is held in close contact with the wire guide holder 32 by virtue of the tension.

Figure 10:
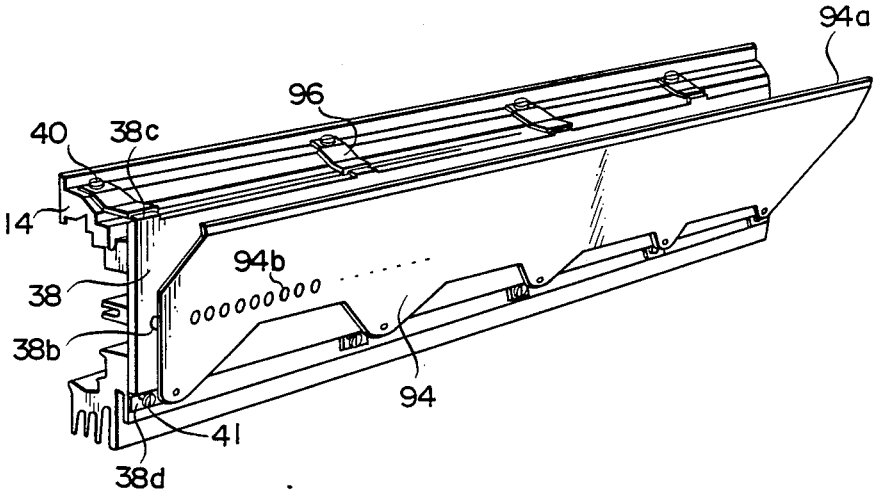
FIG. 10 is a perspective view of a wire mask in accordance with the invention attached to the shuttle frame.
Figure 11:
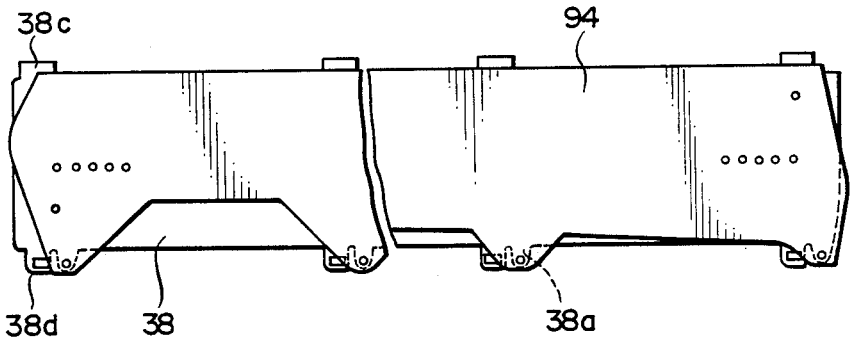
FIG. 11 is an elevational view of the wire mask shown in FIG. 10 with a ribbon mask attached thereto.
Figure 12:
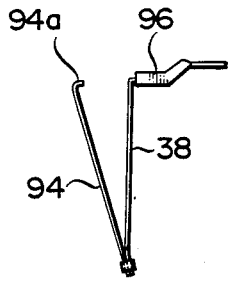
FIG. 12 is a side elevational view of the wire mask shown in FIG. 12.
Figure 13:
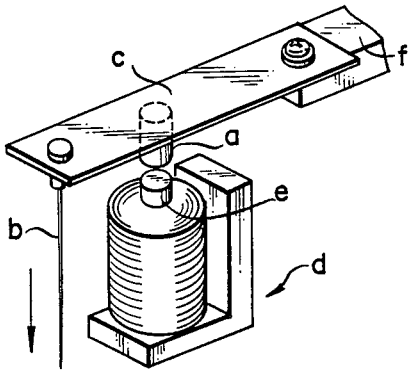
FIG. 13 PRIOR ART
FIG. 13 is a schematic perspective view of a conventional electromagnetic actuator and a printing wire unit.

FIG. 10 shows the wire mask in accordance with the invention in the state of being secured to the shuttle frame 14. A ribbon mask 94 is secured to a plurality of protuberances 38*a* at the lower end of the wire mask 38 by caulking, as is shown in FIGS. 11 and 12. The ribbon mask 94 is useful for separating the ink ribbon from the printing paper. The ink ribbon is inserted between the wire mask 38 and the ribbon mask 94, while the printing paper is inserted between the ribbon mask 94 and the platen.

The use of the wire mask 38 having the ribbon mask 94, prevents any friction between the printing paper and the ribbon even when the shuttle frame 14 moves reciprocally, and thus effectively protects the printing paper agaist being stained.

In an ordinary case, the ribbon mask 94 is formed of a stainless sheet thinner than the wire mask 38, preferably of a 0.1 mm thick sheet.

As described above, the wire mask 38 is strained at the upper and lower sides with the wire guide holder 32 as an apex by a predetermined tension and is held in close contact with the wire guide holder 32. As a result, since unrequired resistance between the wire mask and the ribbon is not produced at the time of travelling and the wire mask 38 is held evenly, the ribbon mask can be correctly positioned along the even wire mask 38, thereby safely eliminating undesirable resistance of the printing paper at the time of travelling.

As is shown in FIG. 12, the ribbon mask 94 and the wire mask 38 are secured to each other with an opening between the upper surfaces thereof, and when the wire mask 38 is fixed to the shuttle frame 14, the ribbon mask 94 is slightly bent toward the platen, as is shown in FIG. 10, which state facilitates insertion of the ink ribbon between the the wire mask 38 and the ribbon mask 94.

After the installation of the ink ribbon, the ribbon mask 94 is pressed against toward the wire mask 38 such as to be fixed with a predetermined small gap left between the printing paper and itself. The ribbon mask 94 may be fixed either by employing a retaining portion 94*a* provided at the upper end of the ribbon mask 94 to retain the upper portion of the wire mask 38 or by providing a hooked portion extending from the shuttle frame 14 and engaging the retaining portion 94*a* therewith.

Needless to say, the wire mask 38 and the ribbon mask 94 are provided with the respective through holes 38*b* and 94*b* at the positions corresponding to the printing wires arranged in alignment with each other, and the printing wires can easily project toward the platen through these lined-up through holes.

A plurality of protuberances 38*c* and 38*d* are provided at the upper and lower ends of the wire mask 38, the latter being secured to the shuttle frame 14 with a predetermined tension by the screws 40 and 41 driven through the protuberances 38*c* and 38*d*.

A heat-shrinkable tube 96 is fitted over a part of the upper protuberance 38*c* in this embodiment, so as to prevent the lead wire introduced from each printing wire unit from coming into contact with the protuberance 38*c* of the wire mask 38 and being cut, or from producing other accidents.

As described above, according to the invention, the portion of the printing spring between the position to which the armature is attached and the free end is bent approximately at right angles, constituting a bent portion, and the remaining flat portion has a tapered form, while the bent portion broadens toward the distal end, whereby the total weight of the printing spring is reduced, the rigidity of the distal end portion thereof is increased, and the responsiveness of the printing spring is thereby enhanced and the fixing strength and working efficiency of the spring wire is increased. Since the indented portion is provided between the armature fixing portion and the base portion of the printing spring, the bending stress of the printing spring is dispersed and durability in the face of repeated flexing is improved.

Furthermore, it should be noted that according to the invention, since the movable member is provided, at the flat portion which is approximately perpendicular to the wire, with the wire hole which surrounds at least half the circumference of the printing wire and, on the flat portion on the side of the wire hole, with the bent portion with which the longitudinal side surface of the printing wire comes into contact, and the printing wire is secured to at least the bent portion, the brazing strength and the brazing properties are improved and the positional accuracy is maintained at a high standard with the minimum number of parts and by employment of a small number of processing steps.

In addition, according to the invention, the wire mask is fixed in a state in which it is strained by a predetermined tension at the upper and lower sides thereof with the wire guide holders as an apex, so that the wire mask is held in close contact with the wire guide holders. Therefore, the distance between the printing wires and the surface of the platen is shortened, and high speed printing is enabled. Furthermore, the wire mask is safely prevented from crinkling or protruding which would lead to obstructing the smooth travel of the printing paper or the ink ribbon, whereby printing quality is improved.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. In a printing head apparatus for a parallel dot printer comprising:

a shuttle frame provided longitudinally along a platen and supported such as to be reciprocally movable along a print line in relation to printing paper and a platen;

a plurality of printing wire units secured to said shuttle frame with all of said plurality of printing wire units being arranged longitudinally along said platen, each printing wire unit including a printing wire which is driven by an energized electromagnetic actuator;

a plurality of wire guides arranged in a row along said print line for positioning and holding the distal end of each printing wire secured to a wire guide holder respectively and being provided on said shuttle frame in correspondence to each printing wire unit; and a wire mask for maintaining the passage of an ink ribbon to be smooth and for protecting a plurality of said printing wires arranged in alignment with each other, said wire mask being secured to said shuttle frame in such a manner that its upper and lower ends are strained tight backwardly with the distal end face of a plurality of said wire guides as an apex making use of the resilience of the wire mask itself so as not to crinkle or protrude toward said platen.

* * * * *